US005774424A

United States Patent [19]

Yoo

[11] Patent Number: 5,774,424

[45] Date of Patent: Jun. 30, 1998

[54] ACUPRESSURE STIMULATOR FOR A WATCH

[76] Inventor: Tae Woo Yoo, 807, 1-Dong, Hanyang Apt., 32-5, Banpo-dong, Seocho-ku, Seoul, Rep. of Korea

[21] Appl. No.: 784,571

[22] Filed: Jan. 21, 1997

[30] Foreign Application Priority Data

Aug. 23, 1996 [KR] Rep. of Korea ..... 96-25365

[51] Int. Cl.[6] ..... G04B 47/00

[52] U.S. Cl. ..... 368/10; 368/327

[58] Field of Search ..... 368/10

[56] References Cited

U.S. PATENT DOCUMENTS

| | | | |
|---|---|---|---|
| D. 344,137 | 2/1994 | Yoo | D24/200 |
| 4,479,495 | 10/1984 | Isaacson | 128/327 |
| 4,716,898 | 1/1988 | Chauve et al. | 128/329 |
| 4,981,146 | 1/1991 | Bertolucci | 128/802 |
| 5,078,728 | 1/1992 | Giarratano | 606/204 |
| 5,445,647 | 8/1995 | Choy | 606/204 |

FOREIGN PATENT DOCUMENTS 96-6881 8/1996 Rep. of Korea .

*Primary Examiner*—Bernard Roskoski
*Attorney, Agent, or Firm*—Richard M. Goldberg

[57] ABSTRACT

An acupressure stimulator for a watch includes a plate; a plurality of protuberances projected from the bottom of the plate for applying finger-pressure to the wrist; a double-sided adhesive-layer stuck on the other side of the plate, in order to use the double-sided adhesive-layer to adhere to the back of a watch; and a release-layer adhered to the double-sided adhesive-layer. In use, after removing the release-layer at the double-sided adhesive-layer, it is stuck to the back of a watch.

4 Claims, 2 Drawing Sheets

ACUPRESSURE STIMULATOR FOR A WATCH

BACKGROUND OF THE INVENTION

1. Field of the Invention

The present invention relates to an acupressure stimulator for a watch and more particularly this invention has a metallic circular plate having a plurality of projections in the bottom thereof and can be stuck on the back of a watch for applying finger-pressure at the wrist.

2. Description of the Prior Art

In general, acupressure or finger-pressure is known as an effective method which helps in blood circulation. However, acupressure or finger-pressure needs to use some instrument or implement and someone's help and to spend a time thereon for having an effect. Therefore, the conventional method is inconvenient.

On the other hand, a watch has an effect of checking a time and as ornamentation. Recently, a watch which has various functions is required.

SUMMARY OF THE INVENTION

The object of the present invention is to provide an acupressure stimulator for a watch which can have an effect of being pressed to each blood vessel around the wrist and stimulating the blood relationship, by holding a watch with the present invention on the back thereof.

According to the invention, to accomplish the above object, there is provided an acupressure stimulator for a watch which comprises a plate, a plurality of protuberances projected from the bottom of the plate for applying finger-pressure at the wrist, a double-sided adhesive-layer being stuck on the opposite surface of the bottom plate and a release-layer adhered to the double-sided adhesive layer.

BRIEF DESCRIPTION OF THE DRAWINGS

The objects and features of the present invention will be hereinafter explained in detail with reference to the accompanying drawings, wherein.

DESCRIPTION OF THE PREFERRED EMBODIMENTS

Figure 1:
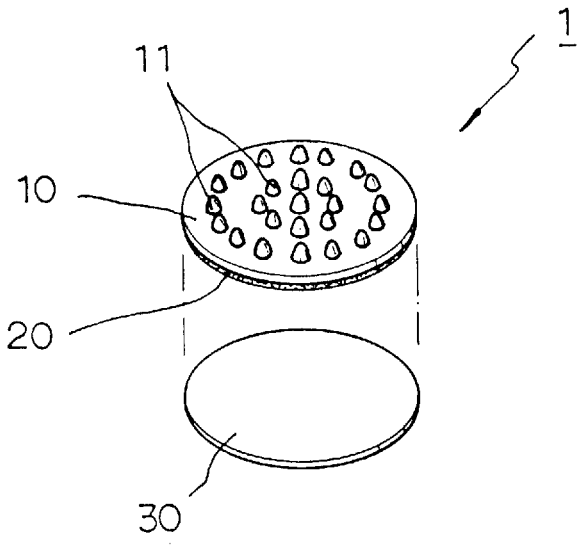
FIG. 1 is a separated perspective view of the present invention.
Figure 2:
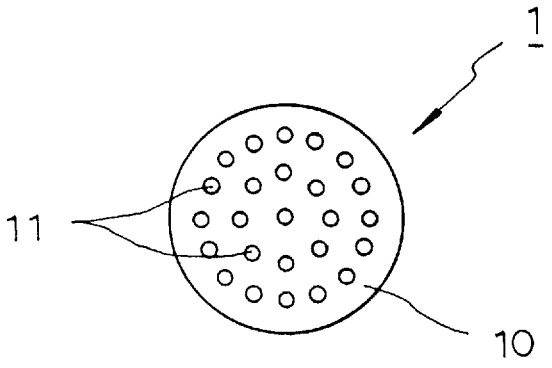
FIG. 2 is a plane view of the present invention.

As shown FIG. 1, a metallic circular plate(10) has a plurality of projections(11) on the bottom thereof A double-sided adhesive-layer(20) is stuck on the opposite surface of the plate bottom.

A release-layer(30) is adhered to the double-sided adhesive-layer.

Figure 3:
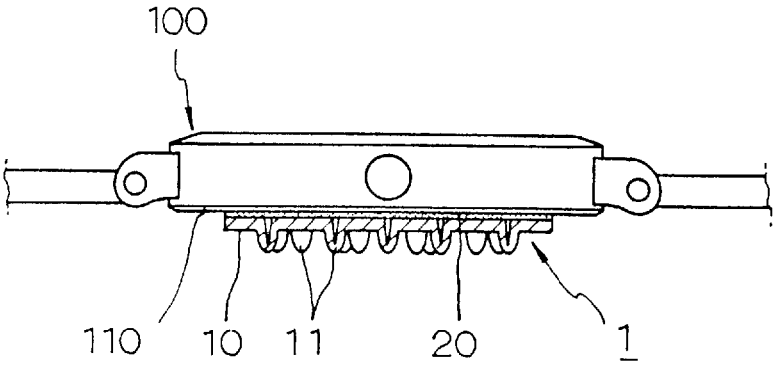
FIG. 3 is a partly sectional view of a watch having the present invention.

After removing the release-layer(30) at the double-sided adhesive-layer(20), as shown FIG. 3, the adhesive-layer(20) is stuck on the back(110) of a watch(100)

In wearing the watch which sticks on the present invention, a plurality of protuberances press and stimulate each blood vessel around the wrist. Therefore, it has an acupressure effect.

Figure 4:
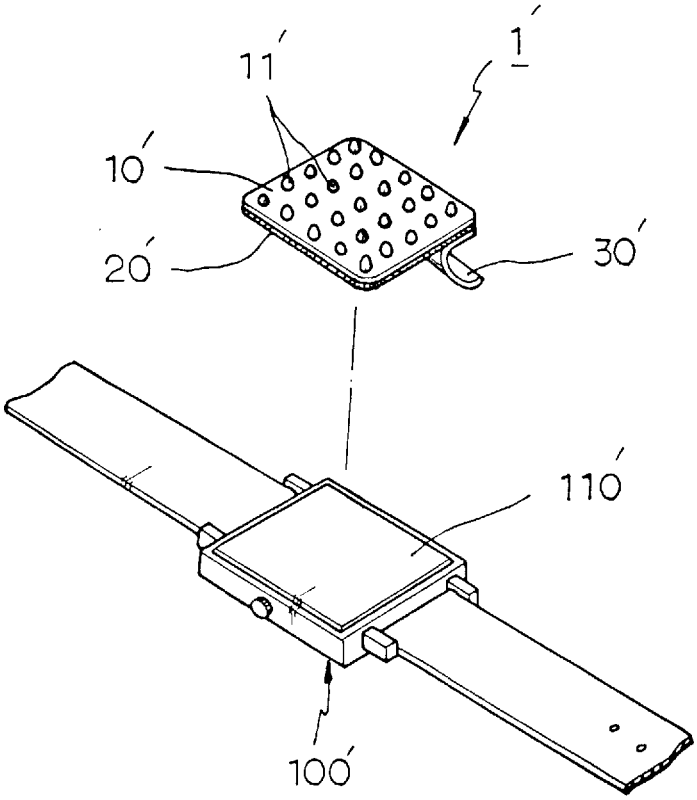
FIG. 4 is a separated perspective view of another embodiment of a watch and the present invention.

As another embodiment, a plate which is a metallic square plate(10') has a plurality of protuberances(11') on the bottom thereof, as shown FIG. 4.

The square plate(10') is stuck on a square shape watch after removing the release-layer(30') at the double-sided adhesive-layer(20').

If the watch which is stuck on this invention is worn, a plurality of protuberances which are projected from the back of the plate are pressed to each blood vessel around the wrist, stimulating the blood relationship continuously.

What is claimed is:

1. A watch comprising:

a watch body, said watch body having an underside;

a watch band for holding the watch body on a wrist of a person; and at least three pointed protuberances projected from the underside of the watch body for applying finger-pressure on the wrist of the person, in order to press and stimulate each blood vessel around the wrist to continuously stimulate blood flow thereat.

2. A watch according to claim 1, wherein said watch body and said plate each have a circular shape.

3. A watch according to claim 1, wherein said watch body and said plate each have a substantially square shape.

4. A watch according to claim 1, further comprising a plate secured to an underside of said watch body, said plate having an exposed surface; and said plurality of protuberances projecting from said plate.

* * * * *